US009751110B2

(12) United States Patent
Stueven et al.

(10) Patent No.: US 9,751,110 B2
(45) Date of Patent: Sep. 5, 2017

(54) METHOD FOR THE CLASSIFICATION OF WATER ABSORBENT POLYMER PARTICLES

(75) Inventors: Uwe Stueven, Bad Soden (DE); Rüdiger Funk, Niedernhausen (DE); Matthias Weismantel, Jossgrund-Oberndorf (DE); Meinhard Nitschke, Bad Bergzabern (DE); Filip Mees, Grobbendonk (BE); Leo Van Miert, Kapellen (BE)

(73) Assignee: BASF AKTIENGESELLSCHAFT, Ludwigshafen (DE)

( * ) Notice: Subject to any disclaimer, the term of this patent is extended or adjusted under 35 U.S.C. 154(b) by 1421 days.

(21) Appl. No.: 12/438,481

(22) PCT Filed: Sep. 24, 2007

(86) PCT No.: PCT/EP2007/060072

§ 371 (c)(1),
(2), (4) Date: Feb. 23, 2009

(87) PCT Pub. No.: WO2008/037672

PCT Pub. Date: Apr. 3, 2008

(65) Prior Publication Data

US 2009/0261023 A1 Oct. 22, 2009

(30) Foreign Application Priority Data

Sep. 25, 2006 (EP) ..... 06121231

(51) Int. Cl.
*B07B 1/28* (2006.01)
*B07B 1/00* (2006.01)
*B07B 13/16* (2006.01)

(52) U.S. Cl.
CPC ..... *B07B 1/28* (2013.01); *B07B 1/00* (2013.01); *B07B 13/16* (2013.01)

(58) Field of Classification Search
CPC ..... B01B 1/28
USPC .... 209/21, 22, 238, 263, 264, 274, 275, 362
See application file for complete search history.

(56) References Cited

U.S. PATENT DOCUMENTS

| | | | | |
|---|---|---|---|---|
| 341,660 | A * | 5/1886 | Kerr | 215/312 |
| 2,702,632 | A * | 2/1955 | Scott | 209/135 |
| 2,946,440 | A * | 7/1960 | Simpson | 209/326 |
| 3,217,561 | A | 11/1965 | Allgaier et al. | |
| 3,290,836 | A * | 12/1966 | Ruppe | 451/36 |
| RE26,555 | E * | 3/1969 | Allgaier et al. | 74/600 |
| 3,476,245 | A * | 11/1969 | Swallow | 209/254 |
| 3,542,594 | A * | 11/1970 | Faust et al. | 134/25.2 |
| 3,568,844 | A * | 3/1971 | Coffelt et al. | 210/327 |
| 3,794,165 | A * | 2/1974 | Riesbeck et al. | 209/325 |
| 3,819,050 | A * | 6/1974 | Lower | 209/254 |
| 3,932,442 | A * | 1/1976 | Salmon et al. | 209/309 |
| 4,077,873 | A * | 3/1978 | McKibben | 209/332 |
| 4,116,824 | A * | 9/1978 | Somkaite et al. | 209/262 |
| 4,201,017 | A * | 5/1980 | Davenport et al. | 451/32 |
| 4,206,046 | A * | 6/1980 | Haight | 209/481 |
| 4,233,159 | A * | 11/1980 | Senda et al. | 210/413 |
| 4,276,157 | A * | 6/1981 | Haight | 209/246 |
| 4,319,995 | A * | 3/1982 | Haight | 209/481 |
| 4,970,759 | A * | 11/1990 | Roberson | 19/105 |
| 5,318,184 | A * | 6/1994 | Krebs | 209/21 |
| 6,059,518 | A * | 5/2000 | Hamilton | 414/754 |
| 6,814,242 | B2 * | 11/2004 | Masukane et al. | 209/691 |
| 7,173,086 | B2 * | 2/2007 | Smith et al. | 524/556 |
| 8,057,685 | B2 * | 11/2011 | Laing | 210/744 |
| 2003/0225157 | A1 * | 12/2003 | Tran et al. | 514/454 |
| 2003/0225173 | A1 * | 12/2003 | Albright et al. | 521/51 |
| 2004/0214499 | A1 * | 10/2004 | Qin et al. | 442/414 |
| 2006/0043006 | A1 | 3/2006 | Garrett et al. | |
| 2007/0045158 | A1 * | 3/2007 | Johnson | 209/11 |
| 2008/0202987 | A1 * | 8/2008 | Weismantel et al. | 209/32 |
| 2009/0050580 | A1 * | 2/2009 | Takao et al. | 210/784 |

FOREIGN PATENT DOCUMENTS

| | | | |
|---|---|---|---|
| DE | 239 907 | C | 10/1911 |
| DE | 10 2005 001 789 | A1 | 7/2006 |
| EP | 0 251 349 | A1 | 1/1988 |
| EP | 855232 | A2 | 7/1998 |
| EP | 0 992 293 | A1 | 4/2000 |
| GB | 623 742 | A | 5/1949 |
| JP | 2003/320308 | A | 11/2003 |
| WO | WO-92/18171 | A1 | 10/1992 |
| WO | WO-2004/050263 | A1 | 6/2004 |

OTHER PUBLICATIONS

Buccholz et al., *Modern Superabsorbent Polymer Technology*, Wiley-VCH, 71-103 (1998).
International Search Report in PCT/EP2007/060072 dated Dec. 28, 2007.
Wessel, *Ullmanns Encyklopaedie der technischen Chemie, 4th Edition*, vol. 2, pp. 43-56, Verlag Chemie, Weinheim (1972).
Firma Laza Kogyo K.K., Tokyo (1998) betreffend runde Klassiervorrichtungen der deutschen, Firma Allgaier.

* cited by examiner

*Primary Examiner* — Michael McCullough
*Assistant Examiner* — Michael E Butler
(74) *Attorney, Agent, or Firm* — Marshall, Gerstein & Borun LLP

(57) ABSTRACT

A process for continuously classifying water-absorbing polymer beads by means of at least one screen, at least one screen having at least one guide device on the screen surface.

20 Claims, No Drawings

METHOD FOR THE CLASSIFICATION OF WATER ABSORBENT POLYMER PARTICLES

CROSS-REFERENCE TO RELATED APPLICATIONS

This is the U.S. national phase of International Application No. PCT/EP2007/060072, filed Sep. 24, 2007, which claims the benefit of European Patent Application No. 06121231.2, filed Sep. 25, 2006.

The present invention relates to a process for continuously classifying water-absorbing polymer beads by means of at least one screen, at least one screen having at least one guide device on the screen surface.

The production of water-absorbing polymer beads is described in the monograph "Modern Superabsorbent Polymer Technology", F. L. Buchholz and A. T. Graham, Wiley-VCH, 1998, pages 71 to 103.

As products which absorb aqueous solutions, water-absorbing polymers are used for the production of diapers, tampons, sanitary napkins and other hygiene articles, but also as water-retaining agents in market gardening.

The properties of the water-absorbing polymers can be adjusted via the degree of crosslinking. With increasing degree of crosslinking, the gel strength rises and the centrifuge retention capacity (CRC) falls.

To improve the use properties, for example saline flow conductivity (SFC) in the diaper and absorbency under load (AUL), water-absorbing polymer beads are generally postcrosslinked. This increases only the degree of crosslinking of the particle surface, which allows absorbency under load (AUL) and centrifuge retention capacity (CRC) to be at least partly decoupled. This postcrosslinking can be performed in the aqueous gel phase. However, dried, ground and screened-off polymer beads (base polymer) are preferably coated on the surface with a postcrosslinker, thermally postcrosslinked and dried. Crosslinkers suitable for this purpose are compounds which comprise at least two groups which can form covalent bonds with the carboxylate groups of the hydrophilic polymer.

The water-absorbing polymers are used as a pulverulent, particulate product preferably in the hygiene sector. Here, for example, particle sizes between 200 and 850 μm are used and the particulate polymer material is classified to these particle sizes actually in the course of the production process. In this case, continuous screening machines with two screens are used, the screens used having the mesh sizes of 200 and 850 μm. Beads having a particle size of up to 200 μm fall through both screens and are collected as undersize at the bottom of the screening machine. Beads having a particle size of greater than 850 μm remain on the uppermost screen as oversize and are discharged. The product fraction having a particle size of greater than 200 to 850 μm is removed as midsize between the two screens of the screening machine. Depending on the screening quality, each particle size fraction still comprises a proportion of particles with the wrong particle size as erroneous discharge. For example, the oversize fraction may also comprise a proportion of particles having a particle size of 850 μm or less.

Discharged undersize and oversize is typically recycled into the production. The undersize can be added, for example, to the polymerization. The oversize is typically comminuted, which inevitably also leads to the occurrence of further undersize.

In the conventional classifying operations, different problems occur when particular polymers are classified. The most frequent problem is the blockage of the screen surface and the deterioration in the classifying efficiency and the classifying ability. A further problem is the caking tendency of the product which leads to undesired agglomerates before, after and during the screening. The process step of screening therefore cannot be performed such that it is free of disruptions, often accompanied by unwanted shutdowns in polymer production. Such disruptions are found to be particularly problematic in the continuous production process. The overall result is, however, insufficient separation efficiency in the screening. These problems are observed in particular in the classification of postcrosslinked product.

A higher screening quality is typically achieved by adding substances to the product which serve to increase the free flow and/or the mechanical stability of the polymer powder. In general, a free-flowing product is achieved when assistants, for example surfactants, which prevent mutual adhesion of the individual particles, are added to the polymer powder, usually after the drying and/or in the course of the postcrosslinking. In other cases, attempts are made to influence the caking tendencies by process technology measures.

In order to achieve higher separation efficiencies without further product additives, improvements by virtue of alternative screening units have been proposed. For instance, higher separation efficiencies are achieved when screen orifice areas are driven in spiral form. This is, for example, the case in tumbling screen machines. When, however, the throughput of such screening apparatus is increased, the above problems are enhanced, and it becomes ever more impossible to maintain the high classifying capability.

The addition of screening aids such as screening balls, PVC friction rings, Teflon-friction rings or rubber cubes on the screen surface only helps insignificantly to improve the separation efficiency. Particularly in the case of amorphous polymer material, such as water-absorbing polymer beads, this can cause increased attrition.

A general overview of classification can be found, for example, in Ullmanns Encyklopädie der technischen Chemie, 4th edition, volume 2, pages 43 to 56, Verlag Chemie, Weinheim, 1972.

EP 855 232 A2 describes a classification process for water-absorbing polymers. Use of heated or thermally insulated screens allows agglomerates below the screen to be avoided, especially in the case of small particle sizes.

DE 10 2005 001 789 A1 describes a classification process which is performed at reduced pressure.

JP 2003/320308 A describes a process in which agglomerates are avoided by virtue of warm air flowing toward the screen underside.

WO 92/18171 A1 describes the addition of inorganic powders as a screening assistant.

It is an object of the present invention to provide an improved classifying process for the production of water-absorbing polymer beads.

This object is achieved by a process for continuously classifying water-absorbing polymer beads by means of at least one screen, wherein at least one screen has at least one guide device on the screen surface.

The inventive guide device deflects the water-absorbing polymer beads moving toward the screen at least partly from their original direction of movement. The inventive guide devices improve the separation efficiency in the classification of water-absorbing polymer beads.

The inventive guide devices are of course different from the lateral screen boundary, which prevents the polymer beads from failing down over the lateral edge of the screen in an undesired manner.

The number of screens in the process according to the invention is preferably at least 2, more preferably at least 3, most preferably at least 4.

The number of guide devices per screen in the process according to the invention is preferably at least 2, more preferably at least 3, most preferably at least 4.

Relative to the screen surface, the guide devices preferably have a height of from 1 to 10 cm, more preferably from 3 to 8 cm, most preferably from 4 to 6 cm. In the case of too low a height, the efficiency of the guide devices falls, since they can be overcome by some of the water-absorbing polymer beads. In contrast, too great a height unnecessarily increases the mechanical stress on the screen as a result of the guide device itself.

In a preferred embodiment of the present invention, at least one guide device concludes flush with the edge of the screen.

The type of screen device for performing the process according to the invention which follows is not restricted any further. It is possible to use any screen device known to those skilled in the art. In order to achieve a relatively high separation efficiency from the outset, preference is given to using tumbling screen apparatus.

The tumbling screen machines suitable for the classification process according to the invention are subject to no restriction. The screen apparatus is typically agitated to support the classification. This is preferably done in such a way that the material to be classified is conducted in spiral form over the screen. This forced vibration typically has an amplitude of from 0.7 to 40 mm, preferably from 1.5 to 25 mm, and a frequency of from 1 to 100 Hz, preferably from 5 to 10 Hz.

The tumbling screen machines usable in the process according to the invention have preferably at least 2, more preferably at least 3, most preferably at least 4, screens. Advantageously, the polymer beads falling down from the upper screen are deflected by a device, preferably funnel-shaped, in the direction of the middle of the lower screen.

The inventive guide devices deflect the water-absorbing polymer beads preferably in the direction of the middle of the screen or in a spiral path toward the exit orifice of the screen. Advantageously, the screens in the process according to the invention have guide devices of both types. The exit orifice of the screen is at the screen edge. The polymer beads which do not pass through the mesh of the screen are withdrawn via the exit orifice.

The figure shows an example of an inventive screen with guide devices. In this figure, the reference symbols are defined as follows:

A: edge of the screen

B: guide device which guides the polymer beads in the direction of the middle of the screen C: guide device which guides the polymer beads in a spiral path toward the exit orifice D: exit orifice at the edge of the screen The guide devices which guide the polymer beads in the direction of the middle of the screen are directed preferably by from 1 to 20%, more preferably by from 3 to 15%, most preferably by from 5 to 10%, based in each case on the screen radius in the direction of the middle of the screen, the value being calculated from the difference of maximum to minimum distance of the guide device from the center of the screen.

The guide devices which guide the polymer beads in the direction of the middle of the screen are preferably straight.

The guide devices which guide the polymer beads in the direction of the middle of the screen have a length of preferably from 5 to 40%, more preferably from 10 to 30%, most preferably from 15 to 25%, based on the screen radius.

The guide devices which guide the polymer beads in a spiral path toward the exit orifice of the screen preferably comprise a circular segment of from 180 to 330° concentric about the center of the screen. The circular segment is more preferably from 270 to 300°.

The diameter of the circle segment is preferably from 50 to 85%, more preferably from 60 to 75%, most preferably from 65 to 70%, based on the screen diameter.

Structure and material of the guide devices are not restricted any further. It is possible to use all materials known to those skilled in the art. Preference is given to using plastics. Examples thereof are:

Thermoplastics, for example polypropylene (PP), polyethylene (PE), polyethylene terephthalate (PET) and polystyrene (PS), acrylonitrile-butadiene-styrene copolymer (ABS), polyacetal (POM), polyamide (PA), polybutylene terephthalate (PBT), polyether sulfone (PES), polycarbonate (PC), polyphenylene sulfide (PPS), polytetrafluoroethylene (PTFE), polyether ether ketone (PEEK), polyimide (PI) or polyvinyl chloride (PVC). These may be used as such, however, their properties (hard or soft) are generally modified with additives. In order to obtain novel properties which have not been available to date, it is also possible to mix two or more thermoplastics.

Thermosets, for example bakelite, synthetic resins, epoxy resins. Thermosets are usually hard and brittle.

Elastomers such as crosslinked rubber. The crosslinking is effected, for example, by vulcanization with sulfur by means of peroxides, metal oxides or irradiation. Examples of elastomers are natural rubber (NR), acrylonitrile-butadiene rubber (NBR), styrene-butadiene rubber (SBR), chloroprene rubber (CR), butadiene rubber (BR), ethylene-propylene-diene rubber (EPDM), silicone elastomers and silicone rubber.

Particular preference is given to using silicones such as silicone rubber and silicone resin. In general, silicone rubbers have a density of from 1.1 to 1.3 g/cm$^3$ and are elastic from −60° C. to 200° C. (special types from −90° C. to 250° C.). Silicone rubbers are compositions which can be converted to the elastomeric state and which comprise polydiorganosiloxanes which have groups amenable to crosslinking reactions. Useful such groups are predominantly hydrogen atoms, hydroxyl groups and vinyl groups which are disposed at the chain ends but may also be incorporated into the chain. Fillers are incorporated into this system as reinforcers, whose type and amount significantly influence the mechanical and chemical behavior of the vulcanizates. Silicone rubbers can be colored by inorganic pigments. A distinction is drawn between high-temperature and room-temperature vulcanizing silicone rubbers (HTV/RTV). The HTV silicone rubbers are usually plastically deformable, still just free-flowing materials which comprise fine silica and, as crosslinking catalysts, organic peroxides, and, after vulcanization at temperatures greater than 100° C., give rise to thermally resistant silicone elastomers (silicone rubber) which are elastic between −100° C. and +250° C., which are used, for example, as sealing materials, thermal insulation materials, electrical insulation materials, cable sheaths and the like. Silicone resins are crosslinked polymethylsiloxanes or polymethylphenylsiloxanes whose elasticity and heat resistance rises with the content of phenyl groups. Pure methylsilicone resins are relatively brittle and moderately heat-resistant.

The processing and production of the guide devices from plastics materials is not restricted any further. It is possible to use all processing methods known to those skilled in the art. Examples are extrusion, injection molding, calendering, foaming, adhesion bonding with and without solvent, vulcanizing.

Screen units in combination with inventive guide devices afford the highest screening quality in the fine and ultrafine screening range. In the case of sensitive products, no particle destruction whatsoever is observed. The use of the guide devices makes possible a higher specific screen loading in comparison to conventional vibration screens. In addition, the guide device enables stable screen movement under full load. Control of the tumbling movement allows the particle residence time on the screen to be altered and performance and screening quality to be balanced relative to one another.

The screens are cleaned by means of product-specific screen cleaning systems. Simple access enables a rapid change of the screen inserts with guide devices. Large throughputs, simple maintenance and low operating costs result in the achievement of optimal economic viability in the case of use of the inventive screens.

The mesh size of the screens is preferably in the range from 100 to 1000 μm, more preferably in the range from 125 to 900 μm, most preferably in the range from 150 to 850 μm.

During the classification, the water-absorbing polymer beads preferably have a temperature of from 40 to 120° C., more preferably from 45 to 100° C., most preferably from 50 to 80° C.

In a preferred embodiment of the present invention, classification is effected under reduced pressure. The pressure is preferably 100 mbar less than ambient pressure.

The classification process according to the invention is particularly advantageously performed continuously. The throughput of water-absorbing polymer is typically at least 100 kg/m$^2$·h, preferably at least 150 kg/m$^2$·h, preferentially at least 200 kg/m$^2$·h, more preferably at least 250 kg/m$^2$·h, most preferably at least 300 kg/m$^2$·h.

The water-absorbing resin is preferably flowed through with a gas stream, more preferably air, during the classification. The gas rate is typically from 0.1 to 10 m$^3$/h per m$^2$ of screen area, preferably from 0.5 to 5 m$^3$/h per m$^2$ of screen area, more preferably from 1 to 3 m$^3$/h per m$^2$ of screen area, the gas volume being measured under standard conditions (25° C. and 1 bar). The gas stream is more preferably heated before entry into the screen apparatus, typically to a temperature of from 40 to 120° C., preferably to a temperature of from 50 to 110° C., preferentially to a temperature of from 60 to 100° C., more preferably to a temperature of from 65 to 90° C., most preferably to a temperature of from 70 to 80° C. The water content of the gas stream is typically less than 5 g/kg, preferably less than 4.5 g/kg, preferentially less than 4 g/kg, more preferably less than 3.5 g/kg, most preferably less than 3 g/kg. A gas stream with low water content can be obtained, for example, by condensing an appropriate amount of water out of a gas stream with relatively high water content by cooling.

In a preferred embodiment of the present invention, a plurality of screening machines are operated in parallel.

The screening machines are typically electrically grounded.

The water-absorbing polymer beads to be used in the process according to the invention may be produced by polymerizing monomer solutions comprising at least one ethylenically unsaturated monomer a), optionally at least one crosslinker b), at least one initiator c) and water d).

The monomers a) are preferably water-soluble, i.e. the solubility in water at 23° C. is typically at least 1 g/100 g of water, preferably at least 5 g/100 g of water, more preferably at least 25 g/100 g of water, most preferably at least 50 g/100 g of water, and preferably have at least one acid group each.

Suitable monomers a) are, for example, ethylenically unsaturated carboxylic acids such as acrylic acid, methacrylic acid, maleic acid, fumaric acid and itaconic acid. Particularly preferred monomers are acrylic acid and methacrylic acid. Very particular preference is given to acrylic acid.

The preferred monomers a) have at least one acid group, the acid groups preferably having been at least partly neutralized.

The proportion of acrylic acid and/or salts thereof in the total amount of monomers a) is preferably at least 50 mol %, more preferably at least 90 mol % and most preferably at least 95 mol %.

The monomers a), especially acrylic acid, comprise preferably up to 0.025% by weight of a hydroquinone monoether. Preferred hydroquinone monoethers are hydroquinone monomethyl ether (MEHQ) and/or tocopherols.

Tocopherol is understood to mean compounds of the following formula

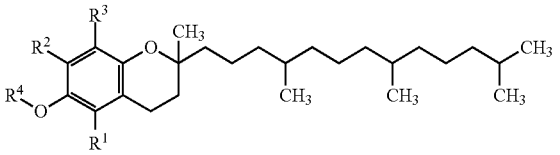

where $R^1$ is hydrogen or methyl, $R^2$ is hydrogen or methyl, $R^3$ is hydrogen or methyl, and $R^4$ is hydrogen or an acyl radical having from 1 to 20 carbon atoms. Preferred radicals for $R^4$ are acetyl, ascorbyl, succinyl, nicotinyl and other physiologically compatible carboxylic acids. The carboxylic acids may be mono-, di- or tricarboxylic acids.

Preference is given to alpha-tocopherol where $R^1$=$R^2$=$R^3$=methyl, in particular racemic alpha-tocopherol. $R^1$ is more preferably hydrogen or acetyl. RRR-alpha-tocopherol is especially preferred.

The monomer solution comprises preferably at most 130 ppm by weight, more preferably at most 70 ppm by weight, preferably at least 10 ppm by weight, more preferably at least 30 ppm by weight, in particular around 50 ppm by weight, of hydroquinone monoether, based in each case on acrylic acid, acrylic acid salts also being considered as acrylic acid. For example, the monomer solution can be prepared by using acrylic acid having an appropriate content of hydroquinone monoether.

The crosslinkers b) are compounds having at least two polymerizable groups which can be polymerized by a free-radical mechanism into the polymer network. Suitable crosslinkers b) are, for example, ethylene glycol dimethacrylate, diethylene glycol diacrylate, allyl methacrylate, trimethylolpropane triacrylate, triallylamine, tetraallyloxyethane, as described in EP 530 438 A1, di- and triacrylates, as described in EP 547 847 A1, EP 559 476 A1, EP 632 068 A1, WO 93/21237 A1, WO 2003/104299 A1, WO 2003/104300 A1, WO 2003/104301 A1 and in DE 103 31 450 A1, mixed acrylates which, as well as acrylate groups, comprise further ethylenically unsaturated groups, as described in DE 103 31 456 A1 and DE 103 55 401 A1, or crosslinker mixtures, as described, for example, in DE 195 43 368 A1, DE 196 46 484 A1, WO 90/15830 A1 and WO 2002/32962 A2.

Suitable crosslinkers b) are in particular N,N'-methylenebisacrylamide and N,N'-methylenebismethacrylamide, esters of unsaturated mono- or polycarboxylic acids of polyols, such as diacrylate or triacrylate, for example butanediol diacrylate, butanediol dimethacrylate, ethylene glycol diacrylate or ethylene glycol dimethacrylate, and also trimethylolpropane triacrylate and allyl compounds such as allyl (meth)acrylate, triallyl cyanurate, diallyl maleate, polyallyl esters, tetraallyloxyethane, triallylamine, tetraallylethylenediamine, allyl esters of phosphoric acid and vinylphosphonic acid derivatives, as described, for example, in EP 343 427 A2. Further suitable crosslinkers b) are pentaerythritol diallyl ether, pentaerythritol triallyl ether and pentaerythritol tetraallyl ether, polyethylene glycol diallyl ether, ethylene glycol diallyl ether, glycerol diallyl ether and glycerol triallyl ether, polyallyl ethers based on sorbitol, and ethoxylated variants thereof. In the process according to the invention, it is possible to use di(meth)acrylates of polyethylene glycols, the polyethylene glycol used having a molecular weight between 100 and 1000.

However, particularly advantageous crosslinkers b) are di- and triacrylates of 3- to 20-tuply ethoxylated glycerol, of 3- to 20-tuply ethoxylated trimethylolpropane, of 3- to 20-tuply ethoxylated trimethylolethane, in particular di- and triacrylates of 2- to 6-tuply ethoxylated glycerol or of 2- to 6-tuply ethoxylated trimethylolpropane, of 3-tuply propoxylated glycerol or of 3-tuply propoxylated trimethylolpropane, and also of 3-tuply mixed ethoxylated or propoxylated glycerol or of 3-tuply mixed ethoxylated or propoxylated trimethylolpropane, of 15-tuply ethoxylated glycerol or of 15-tuply ethoxylated trimethylolpropane, and also of at least 40-tuply ethoxylated glycerol, of at least 40-tuply ethoxylated trimethylolethane or of at least 40-tuply ethoxylated trimethylolpropane.

Very particularly preferred crosslinkers b) are the polyethoxylated and/or -propoxylated glycerols which have been esterified with acrylic acid or methacrylic acid to give di- or triacrylates, as described, for example, in WO 2003/104301 A1. Di- and/or triacrylates of 3- to 10-tuply ethoxylated glycerol are particularly advantageous. Very particular preference is given to di- or triacrylates of 1- to 5-tuply ethoxylated and/or propoxylated glycerol. Most preferred are the triacrylates of 3- to 5-tuply ethoxylated and/or propoxylated glycerol.

The amount of crosslinkers b) is preferably from 0.01 to 5% by weight, more preferably from 0.05 to 2% by weight, most preferably from 0.1 to 1% by weight, based in each case on the monomer solution.

The initiators c) used may be all compounds which disintegrate into free radicals under the polymerization conditions, for example peroxides, hydroperoxides, hydrogen peroxide, persulfates, azo compounds and redox initiators. Preference is given to the use of water-soluble initiators. In some cases, it is advantageous to use mixtures of various initiators, for example mixtures of hydrogen peroxide and sodium or potassium peroxodisulfate. Mixtures of hydrogen peroxide and sodium peroxodisulfate can be used in any proportion.

Particularly preferred initiators c) are azo initiators such as 2,2'-azobis[2-(2-imidazolin-2-yl)propane]dihydrochloride and 2,2'-azobis[2-(5-methyl-2-imidazolin-2-yl)propane]dihydrochloride, and photoinitiators such as 2-hydroxy-2-methylpropio-phenone and 1-[4-(2-hydroxyethoxy)phenyl]-2-hydroxy-2-methyl-1-propan-1-one, redox initiators such as sodium persulfate/hydroxymethylsulfinic acid, ammonium peroxodisulfate/hydroxymethylsulfinic acid, hydrogen peroxide/hydroxymethylsulfinic acid, sodium persulfate/ascorbic acid, ammonium peroxodisulfate/ascorbic acid and hydrogen peroxide/ascorbic acid, photoinitiators such as 1-[4-(2-hydroxyethoxy)-phenyl]-2-hydroxy-2-methyl-1-propan-1-one, and mixtures thereof.

The initiators are used in customary amounts, for example in amounts of from 0.001 to 5% by weight, preferably from 0.01 to 1% by weight, based on the monomers a). For optimal action, the preferred polymerization inhibitors require dissolved oxygen. Therefore, the monomer solution can be freed of dissolved oxygen before the polymerization by inertization, i.e. flowing through with an inert gas, preferably nitrogen. The oxygen content of the monomer solution is preferably lowered before the polymerization to less than 1 ppm by weight, more preferably to less than 0.5 ppm by weight.

The preparation of a suitable polymer and also further suitable hydrophilic ethylenically unsaturated monomers a) are described in DE 199 41 423 A1, EP 686 650 A1, WO 2001/45758 A1 and WO 2003/104300 A1.

Suitable reactors are kneading reactors or belt reactors. In the kneader, the polymer gel formed in the polymerization of an aqueous monomer solution is comminuted continuously by, for example, contrarotatory stirrer shafts, as described in WO 2001/38402 A1. The polymerization on the belt is described, for example, in DE 38 25 366 A1 and U.S. Pat. No. 6,241,928. Polymerization in a belt reactor forms a polymer gel which has to be comminuted in a further process step, for example in a meat grinder, extruder or kneader.

Advantageously, the hydrogel, after leaving the polymerization reactor, is then stored, for example in insulated vessels, at elevated temperature, preferably at least 50° C., more preferably at least 70° C., most preferably at least 80° C., and preferably less than 100° C. The storage, typically for from 2 to 12 hours, further increases the monomer conversion.

In the case of relatively high monomer conversions in the polymerization reactor, the storage can also be shortened significantly or a storage can be dispensed with.

The acid groups of the resulting hydrogels have typically been partially neutralized, preferably to an extent of from 25 to 95 mol %, more preferably to an extent of from 50 to 80 mol % and even more preferably to an extent of from 60 to 75 mol %, for which the customary neutralizing agents can be used, preferably alkali metal hydroxides, alkali metal oxides, alkali metal carbonates or alkali metal hydrogencarbonates and also mixtures thereof. Instead of alkali metal salts, it is also possible to use ammonium salts. Particularly preferred alkali metals are sodium and potassium, but very particular preference is given to sodium hydroxide, sodium carbonate or sodium hydrogencarbonate and also mixtures thereof.

Neutralization is preferably carried out at the monomer stage. It is done typically by mixing in the neutralizing agent as an aqueous solution, as a melt, or else preferably as a solid material. For example, sodium hydroxide having a water content of distinctly below 50% by weight can be present as a waxy mass having a melting point of above 23° C. In this case, metering as piece material or melt at elevated temperature is possible.

However, it is also possible to carry out neutralization after the polymerization, at the hydrogel stage. It is also possible to neutralize up to 40 mol %, preferably from 10 to 30 mol % and more preferably from 15 to 25 mol % of the acid groups before the polymerization by adding a portion of the neutralizing agent actually to the monomer solution and setting the desired final degree of neutralization only after the polymerization, at the hydrogel stage. When the hydrogel is neutralized at least partly after the polymerization, the hydrogel is preferably comminuted mechanically, for example by means of a meat grinder, in which case the neutralizing agent can be sprayed, sprinkled or poured on and then carefully mixed in. To this end, the gel mass obtained can be repeatedly ground in a meat grinder for homogenization.

The hydrogel is then preferably dried with a belt dryer until the residual moisture content is preferably below 15% by weight and especially below 10% by weight, the water content being determined by EDANA (European Disposables and Nonwovens Association) recommended test method No. 430.2-02 "Moisture content". If desired, however, drying can also be carried out using a fluidized bed dryer or a heated plowshare mixer. To obtain particularly white products, it is advantageous to dry this gel while ensuring rapid removal of the evaporating water. To this end, the dryer temperature must be optimized, the air feed and removal has to be controlled, and sufficient venting must be ensured in each case. The higher the solids content of the gel, the simpler the drying, by its nature, and the whiter the product. The solids content of the gel before the drying is therefore preferably between 30% and 80% by weight. It is particularly advantageous to vent the dryer with nitrogen or another nonoxidizing inert gas. If desired, however, it is also possible simply just to lower the partial pressure of the oxygen during the drying in order to prevent oxidative yellowing processes.

Thereafter, the dried hydrogel is ground and classified, and the apparatus used for grinding may typically be single- or multistage roll mills, preferably two- or three-stage roll mills, pin mills, hammer mills or vibratory mills.

The mean particle size of the polymer beads removed as the product fraction is preferably at least 200 μm, more preferably from 250 to 600 μm, very particularly from 300 to 500 μm. The mean particle size of the product fraction may be determined by means of the EDANA (European Disposables and Nonwovens Association) recommended test method No. 420.2-02 "Particle size distribution", where the proportions by mass of the screen fractions are plotted in cumulated form and the mean particle size is determined graphically. The mean particle size here is the value of the mesh size which gives rise to a cumulative 50% by weight.

To further improve the properties, the polymer beads may be postcrosslinked. Suitable postcrosslinkers are compounds which comprise at least two groups which can form covalent bonds with the carboxylate groups of the hydrogel. Suitable compounds are, for example, alkoxysilyl compounds, polyaziridines, polyamines, polyamidoamines, di- or polyepoxides, as described in EP 83 022 A2, EP 543 303 A1 and EP 937 736 A2, di- or polyfunctional alcohols, as described in DE 33 14 019 A1, DE 35 23 617 A1 and EP 450 922 A2, or β-hydroxyalkylamides, as described in DE 102 04 938 A1 and U.S. Pat. No. 6,239,230.

Additionally described as suitable postcrosslinkers are cyclic carbonates in DE 40 20 780 C1,2-oxazolidone and its derivatives, such as 2-hydroxyethyl-2-oxazolidone, in DE 198 07 502 A1, bis- and poly-2-oxazolidinones in DE 198 07 992 C1,2-oxotetrahydro-1,3-oxazine and its derivatives in DE 198 54 573 A1, N-acyl-2-oxazolidones in DE 198 54 574 A1, cyclic ureas in DE 102 04 937 A1, bicyclic amide acetals in DE 103 34 584 A1, oxetanes and cyclic ureas in EP 1 199 327 A2 and morpholine-2,3-dione and its derivatives in WO 2003/31482 A1.

In addition, it is also possible to use postcrosslinkers which comprise additional polymerizable ethylenically unsaturated groups, as described in DE 37 13 601 A1.

The amount of postcrosslinker is preferably from 0.01 to 1% by weight, more preferably from 0.05 to 0.5% by weight, most preferably from 0.1 to 0.2% by weight, based in each case on the polymer.

In a preferred embodiment of the present invention, polyvalent cations are applied to the particle surface in addition to the postcrosslinkers.

The polyvalent cations usable in the process according to the invention are, for example, divalent cations such as the cations of zinc, magnesium, calcium and strontium, trivalent cations such as the cations of aluminum, iron, chromium, rare earths and manganese, tetravalent cations such as the cations of titanium and zirconium. Possible counterions are chloride, bromide, sulfate, hydrogensulfate, carbonate, hydrogencarbonate, nitrate, phosphate, hydrogenphosphate, dihydrogenphosphate and carboxylate, such as acetate and lactate. Aluminum sulfate is preferred. Apart from metal salts, it is also possible to use polyamines as polyvalent cations.

The amount of polyvalent cation used is, for example, from 0.001 to 0.5% by weight, preferably from 0.005 to 0.2% by weight, more preferably from 0.02 to 0.1% by weight, based in each case on the polymer.

The postcrosslinking is typically performed in such a way that a solution of the postcrosslinker is sprayed onto the hydrogel or the dry polymer beads. The spraying is followed by thermal drying, and the postcrosslinking reaction can take place either before or during the drying.

The spraying of a solution of the crosslinker is preferably performed in mixers with moving mixing tools, such as screw mixers, paddle mixers, disk mixers, plowshare mixers and shovel mixers. Particular preference is given to vertical mixers, very particular preference to plowshare mixers and shovel mixers. Suitable mixers are, for example, Lödige mixers, Bepex mixers, Nauta mixers, Processall mixers and Schugi mixers.

The thermal drying is preferably carried out in contact dryers, more preferably paddle dryers, most preferably disk dryers. Suitable dryers are, for example, Bepex dryers and Nara dryers. Moreover, it is also possible to use fluidized bed dryers.

The drying can be effected in the mixer itself, by heating the jacket or blowing in warm air. Equally suitable is a downstream dryer, for example a staged dryer, a rotary tube oven or a heatable screw. It is particularly advantageous to mix and dry in a fluidized bed dryer.

Preferred drying temperatures are in the range from 100 to 250° C., preferably from 120 to 220° C. and more preferably from 130 to 210° C. The preferred residence time at this temperature in the reaction mixer or dryer is preferably at least 10 minutes, more preferably at least 20 minutes, most preferably at least 30 minutes.

Subsequently, the postcrosslinked polymer can be classified again.

The mean diameter of the polymer beads removed as the product fraction is preferably at least 200 μm, more preferably from 250 to 600 μm, very particularly from 300 to 500 μm. 90% of the polymer beads have a diameter of preferably from 100 to 800 μm, more preferably from 150 to 700 μm, most preferably from 200 to 600 μm.

The water-absorbing polymer beads have a centrifuge retention capacity (CRC) of typically at least 15 g/g, preferably at least 20 g/g, preferentially at least 25 g/g, more preferably at least 30 g/g, most preferably at least 35 g/g.

The centrifuge retention capacity (CRC) of the water-absorbing polymer beads is typically less than 60 g/g, the centrifuge retention capacity (CRC) being determined by the EDANA (European Disposables and Nonwovens Association) recommended test method No. 441.2-02 "Centrifuge retention capacity".

EXAMPLES

Comparative Example

By continuously mixing water, 50% by weight sodium hydroxide solution and acrylic acid, a 38.8% by weight acrylic acid/sodium acrylate solution was prepared, such that the degree of neutralization was 71.3 mol %. After the mixing of the components, the monomer solution was cooled continuously by a heat exchanger.

The ethylenically polyunsaturated crosslinker used is polyethylene glycol-400 diacrylate (diacrylate of a polyethylene glycol having a mean molar mass of 400 g/mol). The amount used was 2 kg per t of monomer solution.

To initiate the free-radical polymerization, the following components were used: hydrogen peroxide (1.03 kg (0.25% strength by weight) per t of monomer solution), sodium peroxodisulfate (3.10 kg (15% strength by weight) per t of monomer solution) and ascorbic acid (1.05 kg (1% strength by weight) per t of monomer solution).

The throughput of the monomer solution was 20 t/h.

The individual components were metered continuously into a List Contikneter continuous kneader with capacity 6.3 $m^3$ (from List, Arisdorf, Switzerland) in the following amounts:

| | |
|---|---|
| 20 t/h | of monomer solution |
| 40 kg/h | of polyethylene glycol-400 diacrylate |
| 82.6 kg/h | of hydrogen peroxide solution/sodium peroxodisulfate solution |
| 21 kg/h | of ascorbic acid solution |

Between the addition points for crosslinker and initiators, the monomer solution was inertized with nitrogen.

At the end of the reactor, 1000 kg/h of removed undersize having a particle size of less than 150 μm were additionally metered in.

At the feed, the reaction solution had a temperature of 23.5° C. The reactor was operated with a rotational speed of the shafts of 38 rpm. The residence time of the reaction mixture in the reactor was 15 minutes.

After polymerization and gel comminution, the aqueous polymer gel was introduced into a belt dryer. The residence time on the dryer belt was approx. 37 minutes.

The dried hydrogel was ground and screened. The fraction having the particle size from 150 to 850 μm was postcrosslinked.

The postcrosslinker solution was sprayed onto the polymer beads in a Schugi mixer (from Hosokawa-Micron B. V., Doetichem, the Netherlands). The postcrosslinker solution was a 2.7% by weight solution of ethylene glycol diglycidyl ether in propylene glycol/water (weight ratio 1:3).

The following amounts were metered in:

| | |
|---|---|
| 7.5 t/h | of water-absorbing polymer beads (base polymer) |
| 308.25 kg/h | of postcrosslinker solution |

This was followed by drying and postcrosslinking in a NARA paddle dryer (from GMF Gouda, Waddinxveen, the Netherlands) at 150° C. for 60 minutes.

The postcrosslinked polymer beads were cooled to 60° C. in a NARA paddle dryer (from GMF Gouda, Waddinxveen, the Netherlands).

The cooled polymer beads were screened continuously (Aligaier Werke GmbH, Uhingen, Germany) with three screen decks. The screens had a diameter of 260 cm in each case and had, from the bottom upward, a meash size of 150 μm, 500 μm and 850 μm.

The two screen fractions in the range from 150 to 850 μm were combined and analyzed. The particle size distribution was determined photooptically with a PartAn Particle Analyzer (from AnaTec, Duisburg, Germany). The measurement results are compiled in the table.

Example 1

The procedure of the comparative example was repeated.

The lowermost screen had guide devices according to Figure 1. The three linear guide devices at the edge of the screen were 30 cm-long and the maximum distance from the edge of the screen was 10 cm. The circular section of the spiral-shaped guide device was a circular segment of approx. 300° and had a radius of approx. 175 cm. The height of the guide devices was 5 cm.

Example 2

The procedure of Example 1 was repeated. All screens of the tumbling screen machine had guide devices like the lowermost screen in Example 1.

Table: Particle size distribution

| Particle size [μm] | Comparative Example [%] | Example 1 [%] | Example 2 [%] |
|---|---|---|---|
| >800 | 0.3 | 0.4 | 0.6 |
| >700-800 | 3.6 | 4.4 | 10.3 |
| >600-700 | 18.1 | 18.1 | 16.5 |
| >500-600 | 18.5 | 21.1 | 19.0 |
| >400-500 | 17.8 | 20.1 | 19.6 |
| >350-400 | 14.0 | 16.0 | 17.0 |
| >300-350 | 7.8 | 7.9 | 7.9 |
| >250-300 | 6.0 | 5.0 | 5.0 |
| >200-250 | 5.2 | 3.4 | 3.0 |
| >150-200 | 3.7 | 2.5 | 1.0 |
| >120-150 | 2.8 | 1.0 | 0.1 |
| >90-120 | 1.2 | 0.1 | 0.0 |
| ≤90 | 1.0 | 0.0 | 0.0 |

The invention claimed is:

1. A process for continuously classifying dried water-absorbing polymer beads comprising deflecting dried polymer beads moving toward a screen at least partly from an original direction of movement to the middle of the screen by at least one first guide device on the screen surface, and guiding the polymer beads in a spiral path toward an exit orifice at the edge of the screen by a second guide device, wherein the water-absorbing polymer beads, during the classification, have a water content below 15 wt % and have a temperature of at least 40° C.

2. The process according to claim 1, wherein the guide device has a height of from 1 to 10 cm relative to the screen surface.

3. The process according to claim 1, wherein the at least one guide device concludes flush to the edge of the screen at one end.

4. The process according to claim 1, wherein a tumbling screen machine is used.

5. The process according to claim 4, wherein the tumbling screen machine has at least two screens.

6. The process according to claim 5, wherein the tumbling screen machine, between the at least two screens, has a device for deflecting the polymer beads falling down from an upper screen in the direction of a middle of a lower screen.

7. The process according to claim 1, wherein the first guide device directing the polymer beads toward the middle of the screen is directed by at least 1%, based on screen radius, toward the middle of the screen.

8. The process according to claim 1, wherein the first guide device directing the polymer beads toward the middle of the screen is straight.

9. The process according to claim 1, wherein the first guide device directing the polymer beads toward the middle of the screen has a length of from 5 to 20% based on screen radius.

10. The process according to claim 1, wherein the second guide device which guides the polymer beads in a spiral path toward the exit orifice of the screen comprises a circular segment of at least 180° concentric about the screen center.

11. The process according to claim 10, wherein the circular segment concentric about the screen center has a diameter of at least 50% based on the screen diameter.

12. The process according to claim 1, wherein all screens have at least one first guide device.

13. The process according to claim 1, wherein at least one screen has a mesh width in the range from 100 to 1000 μm.

14. The process according to claim 1, wherein the classification is effected under reduced pressure.

15. The process according to claim 1, wherein a throughput per hour of water-absorbing polymer beads in the course of classification is at least 100 kg per $m^2$ of screen area.

16. The process according to claim 1, wherein the water-absorbing polymer beads are flowed over by a gas stream during the classification.

17. The process according to claim 16, wherein the gas stream has a temperature of from 40 to 120° C.

18. The process according to claim 16, wherein the gas stream has a steam content of less than 5 g/kg.

19. The process according to claim 1, wherein the water-absorbing polymer beads comprise at least partly neutralized polymerized acrylic acid to an extent of at least 50 mol %.

20. The process according to claim 1, wherein the water-absorbing polymer beads have a centrifuge retention capacity of at least 15 g/g.

* * * * *